US006839999B2

(12) United States Patent
Beretta

(10) Patent No.: US 6,839,999 B2
(45) Date of Patent: Jan. 11, 2005

(54) INTERCHANGEABLE RIB

(75) Inventor: Ugo Gussalli Beretta, Gardone Val Trompia (IT)

(73) Assignee: Fabbrica d'Armi Pietro Beretta S.p.A., Gardone Val Trompia (IT)

( * ) Notice: Subject to any disclaimer, the term of this patent is extended or adjusted under 35 U.S.C. 154(b) by 0 days.

(21) Appl. No.: 10/774,005

(22) Filed: Feb. 6, 2004

(65) Prior Publication Data

US 2004/0200116 A1 Oct. 14, 2004

(30) Foreign Application Priority Data

Feb. 12, 2003 (IT) ..... MI2003A0253

(51) Int. Cl.[7] ..... F41C 27/00
(52) U.S. Cl. ..... 42/112; 42/148
(58) Field of Search ..... 42/112, 148

(56) References Cited

U.S. PATENT DOCUMENTS 1,160,157 A * 11/1915 Flues ..... 42/112
2,431,991 A 12/1947 Crowe
2,496,854 A * 2/1950 Crank ..... 42/76.01
2,693,659 A 11/1954 Simmons
3,107,450 A 10/1963 Silva et al.
3,325,937 A 6/1967 Morrow
4,878,308 A * 11/1989 Rose ..... 42/112
5,715,626 A * 2/1998 Scaramucci ..... 42/112

FOREIGN PATENT DOCUMENTS

BE 856604 1/1978
FR 1 490 310 7/1967

OTHER PUBLICATIONS

EPO Search Report.

* cited by examiner

*Primary Examiner*—Michael J. Carone
*Assistant Examiner*—M. Thomson
(74) *Attorney, Agent, or Firm*—Hedman & Costigan, P.C.

(57) ABSTRACT

An interchangeable rib (40) for a rifle that is U-shaped and comprising an aiming plane (41) and two interfacing longitudinal fins (43), defining a channel (45) between them suitable for slidably receiving a band (60) equipped with shaped openings (62) inside of it, each of the shaped openings (62) being suitable for engaging a corresponding column (22) extending from a fixed base (20) to a barrel (10) of the rifle, the rib (40) being equipped with a slot (48) corresponding to an actuation hole (65) formed in the band (60) through which it is possible to actuate the sliding of the band (60) so as to take the edges of the shaped openings (62) to engage in grooves (23) realised along the columns (22) to prevent the detachment of the rib, the rib (40) also comprising, at at least one of its ends, a top lever seat (51) which is coupled with at least one top lever base (30, 31) correspondingly realised on the barrel to prevent the longitudinal sliding of the rib.

10 Claims, 3 Drawing Sheets

40
41
42
42'
43
46
47
48
49
50
51
52
60
62
63
64
65

INTERCHANGEABLE RIB

The present invention concerns an interchangeable rib. In particular, the present invention concerns an interchangeable rib for a rifle intended for hunting or sporting activities.

In the field of long firearms different types of rifles have been realised for hunting activities and for many sporting specialities, for example Trap, Skeet and Sporting.

Amongst the main types of rifles there are: juxtaposed or parallel rifles known by the classic name "double-barrel", which has two barrels and one shot per barrel; over and under rifle with two barrels and one shot per barrel; semi-automatic rifle with one barrel with multiple shot magazine; repeating rifle equipped with a barrel with multiple shot magazine.

According to the different design of rifles, the ribs are also different both for structural purposes and for functional purposes.

In juxtaposed double-barrelled rifles there is an upper rib used for aiming and a lower one which works with the first to hold the barrels together.

In over and under rifles there are two side ribs and an upper rib used for aiming.

The latter is also present in semi-automatic rifles.

In recent years over and under and semi-automatic rifles have had great success and have become increasingly widespread, both in skeet shooting competitions in the various classes and in hunting activities.

The barrel, which in these two types of rifle appears or actually is unique to the firer, eases aiming and, structurally, the various stresses are directed in a coaxial direction not producing misaligned effects that are harmful for closing mechanisms.

In the development of constructive technology, the search for greater manoeuvrability, precision aiming and versatility as well as balance requires a continuous search for innovative solutions in all of the components of the rifle.

In particular, for correct balancing the distribution of masses, which is obtained thanks to the application of an appropriate rib, also takes on great importance. The rib conventionally fixed and solid, i.e. as a full profile welded to the barrel, for all of its length, is currently realised in its so-called ventilated configuration, i.e. slightly elevated with respect to the barrel and with empty spaces.

Moreover, the rib is used to ease aiming and both in some sporting disciplines and during hunting on varied terrains, it is important for it to be possible to replace the rib to allow, through suitable balancing of the rifle, an effective and particularly precise hold thanks to suitable different width and/or colouring.

In different skeet shooting disciplines, moreover, shooters require different widths of the aiming line to optimise personal performance; it is also necessary for the centre of gravity of the shot to correspond to the centre of the target or, as required, even displaced upwards by a variable amount, up to 25–30 cm.

The shooter also needs to vary the balance of the barrel to move the centre of gravity of the firearm or to reduce the moment of inertia.

To satisfy such balance requirements interchangeable ribs have been proposed made in different sizes and with different materials such as steel, light alloy, carbon fibre and others.

To modify the point of impact the inclination of the aiming line with respect to the axis of the barrel is modified.

In a first type of removable rib, on the lower part of the rib a "swallowtail" is formed which is slotted for its entire length on the supports welded on the barrel and locked into position by a pin.

Such a type of rib is not really interchangeable but only removable thanks to a mechanical attachment which nevertheless has the drawback of not being easy to disassemble.

A second type of removable rib foresees the attachment to the small columns welded on the barrels through a pin operating for example with a suitable hammer and a pin driver.

Although this second type of rib has proved versatile and, thanks to the materials used, light, is nevertheless has a limit in the assembly/disassembly system.

Such a rib, indeed, requires a pin which, due to its small size, can be lost and the two aforementioned tools for the assembly of the pin.

Moreover, such assembly/disassembly requires a certain expertise given the non-optimal conditions in which the shooter has to carry out the replacement of the rib.

The general purpose of the present invention is therefore that of realising an interchangeable rib which allows the replacement thereof through an extremely simple operation to give the shooter the possibility of quickly adjusting the shooting parameters and the inertia of the rifle keeping the general ergonomic characteristics of the rifle unchanged even in awkward locations or in difficult conditions.

Another purpose of the present invention is that of providing an interchangeable rib which does not require particular tools for replacement and which does not require small detached parts for its attachment to the barrel.

A further purpose of the present invention is that of realising an interchangeable rib which has an attachment system which is easy and cost-effective to realise.

Yet another purpose of the present invention is that of realising a rifle suitable for receiving an interchangeable rib and a rifle barrel built to receive an interchangeable rib.

These and other purposes according to the present invention are accomplished by a rifle with an interchangeable rib according to that which is outlined in the independent claims.

Further characteristics of the invention form the object of the dependent claims.

The interchangeable rib according to the invention is U-shaped and comprises an aiming plane and two interfacing longitudinal fins, defining a channel between them suitable for slidably receiving a band equipped with shaped openings inside of it, each of said shaped openings being suitable for engaging a corresponding column extending from a fixed base to a barrel of the rifle, said rib being equipped with a slot corresponding to an actuation hole formed in said band through which it is possible to actuate the sliding of said band so as to take the edges of said shaped openings to engage in grooves realised along said columns to prevent the detachment of the rib, said rib also comprising, at at least one of its ends, a top lever seat which is coupled with at least one top lever base correspondingly realised on the barrel to prevent the longitudinal sliding of the rib.

The characteristics and advantages of the interchangeable rib according to the present invention shall become clearer from the following description, given as an example and not for limiting purposes, referring to the attached schematic drawings in which.

Figure 1:
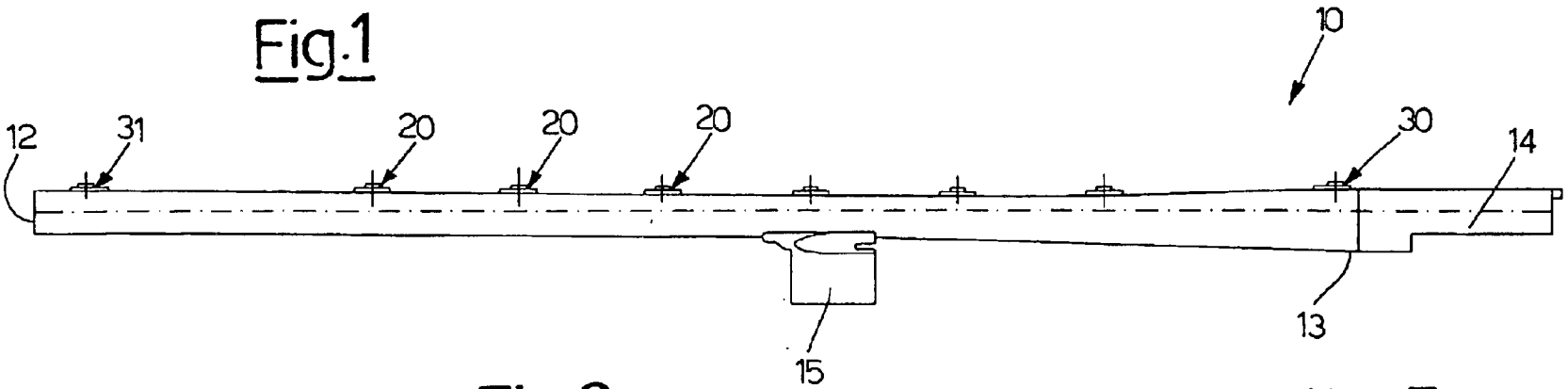
FIG. 1 is a schematic top view of a rifle barrel according to the invention arranged to receive an interchangeable rib.
Figure 5:
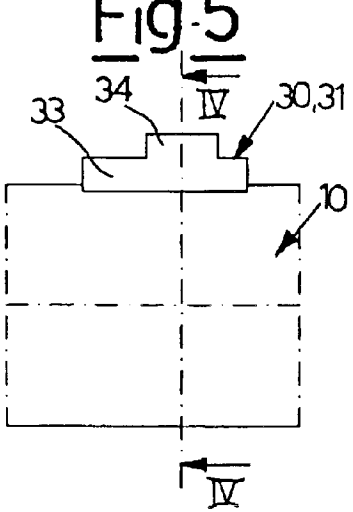
FIG. 5 is an enlarged view of a different detail of FIG. 1.
Figure 4:
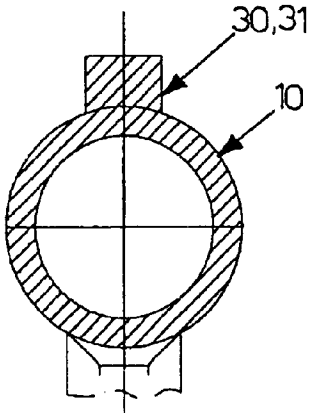
FIG. 4 is a schematic partial section view of a different detail of FIG. 1 according to the line IV—IV of FIG. 5.
Figure 3:
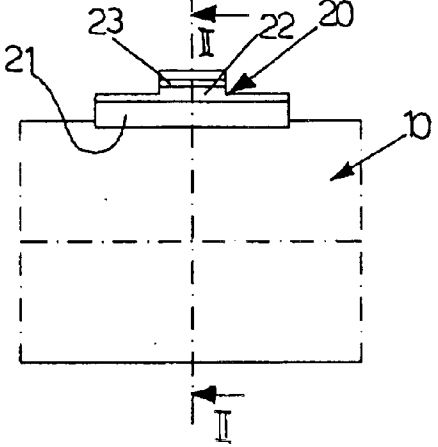
FIG. 3 is an enlarged view of a detail of FIG. 1.
Figure 2:
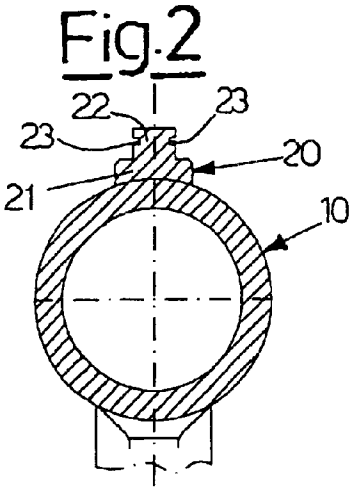
FIG. 2 is a schematic partial section view of a detail of FIG. 1 according to the line II—II of FIG. 3.

With reference to FIGS. 1 to 5, a disassembled rifle barrel 10 is schematised having a chase end 12 and a breech plane 13 terminating in an extension 14 which engages in the breech block (not illustrated).

In the preferred embodiment of the invention, the barrel is part of an over and under or semi-automatic rifle but the invention is in any case also applicable without conceptual variations to other types of rifle like double-barrelled rifles.

Below the barrel 10, in a central position, a gas operated system 15 suitable for allowing the discharge of the gases generated by high potential cartridges is indicated.

Near to the breech plane 13, the barrel is tapered with the outer diameter increasing towards the breech plane 13 and the extension 14.

In an upper position, the barrel 10 has, fixed along a single generatrix, a plurality of identical bases 20 that are aligned at regular intervals along such a generatrix parallel to the longitudinal axis of the barrel.

The bases 20 are used for the attachment of an interchangeable rib 40.

Near to the breech plane 13 and to the chase end 12 at least one, but preferably two top lever bases 30, 31, which extend the line of the bases 20 respectively towards the breech plane 13 and towards the chase end 12, are also fixed on the barrel 10 again along the same generatrix of the bases 20.

Such top lever bases 30, 31 have the function of a top lever lock to prevent the movement in the longitudinal direction of the rib and to oppose the forces which tend to move the rib during the shooting action.

Each of the bases 20 has a support foot 21 through which it is fixed, preferably through welding, to the barrel 10.

Each support foot is topped by a shaped column 22 coming out from the support foot 21 in the radial direction with respect to the barrel 10.

Such a column 22 is grooved along the sides in the longitudinal direction so as to realise a pair of engagement seats or grooves 23 intended to lock the rib.

In the same way, the top lever bases 30, 31 have a foot 33 having the same functions as the foot 21, topped by a top lever 34 intended to engage the rib.

Figures 6, 7, 8:
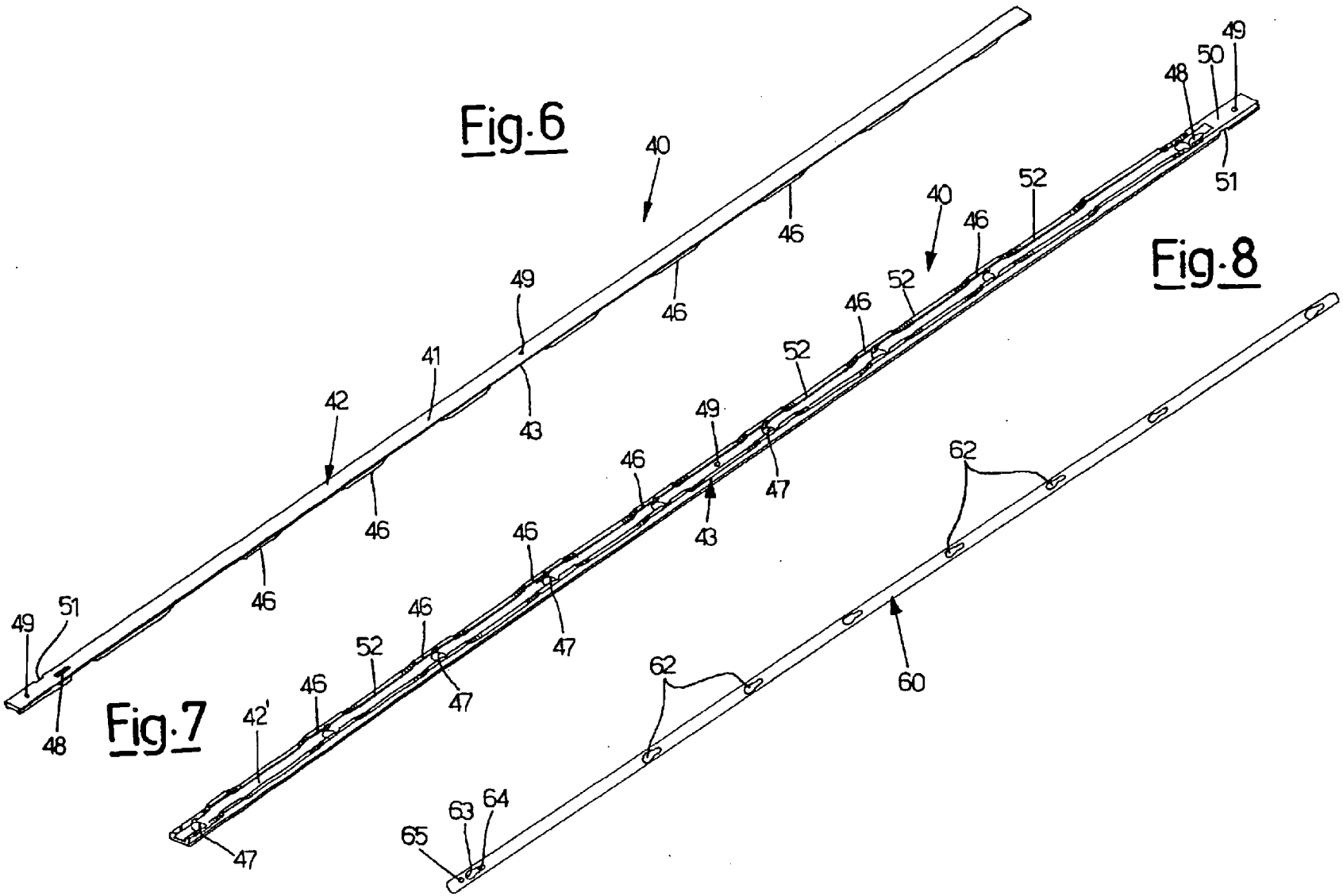
FIG. 6 is a perspective view from above of the rib according to the invention.
FIG. 7 is a perspective view from below of the rib according to the invention.
FIG. 8 is a perspective view of a detail of the rib according to the invention.
Figure 9:
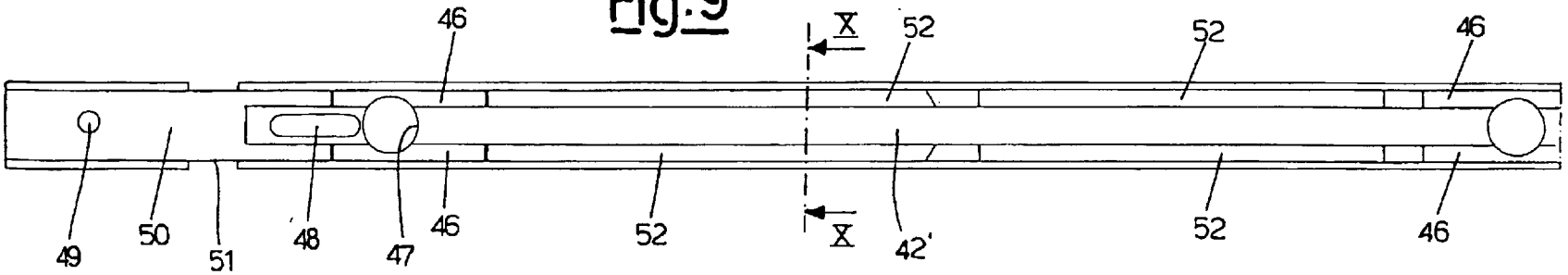
FIG. 9 is a plan view from below of the rib according to the invention.
Figure 10:
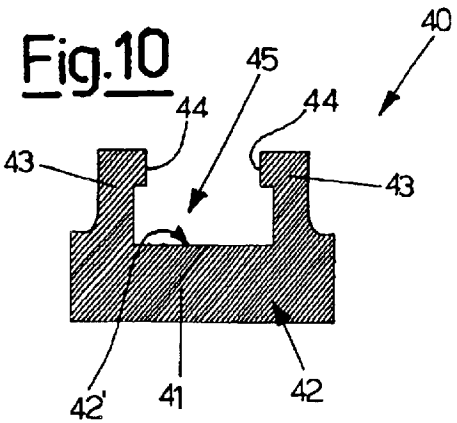
FIG. 10 is a schematic section of the rib according to the line X—X of FIG. 9.

As illustrated in FIGS. 6 to 10, the interchangeable rib 40 is realised through a substantially prism-shaped element with low width and height and with length corresponding to the length of the barrel 10.

The rib 40 comprises an aiming plane 41 the outer surface 42 of which, with reference to the rib mounted on the barrel, corresponds to the aiming line and is previously processed, with anti-glare finish.

The rib has a substantially U-shaped section in which two fins 43 go up from the aiming plane 41 which define, together with the aiming plane, a longitudinal channel 45 intended for the insertion of a band 60.

The fins 43 can be parallel, conical or with different shapes to respond to the structural as well as aesthetic requirements of the rib.

Such fins have, at regular intervals, a series of projections 46 foreseen at the positions of the bases 20, 30, 31 so as to copy the shape of these for assembly.

The fins 43 are processed so as to have, on the inside, a converging profile and/or projections 44 directed inwards so as to partially close the upper portion of the channel 45 in order to hold the band 60 inside of it.

The channel 45 is open towards the rear part of the rib, near to the breech plane 13 and interrupts near to the chase end 12 since an abutment 50 is foreseen realised in the form of a thickening of the aiming plane 41.

Between two adjacent projections 46, the fins have reduced height so as to realise ports 52 which give the rib the ventilated characteristic.

At at least one of its ends corresponding to the chase end or the breech plane of the barrel 10, but preferably at both ends, the rib has a top lever seat 51 which is engaged, when the rib is positioned on the barrel, by the top lever bases 30, 31 to prevent the axial movement of the rib.

The inner surface 42' of the aiming plane 41 of the rib has, between the projections 46, a plurality of equidistant cylindrical seats 47, formed in the surface of the aiming plane without crossing it, each arranged between two interfacing projections, to house the end of a column 22.

Near to the end corresponding to the chase end of the barrel, the rib has a slot 48 which crosses the aiming plane 41 to allow the passage of the tool for actuating the band 60 for attaching the rib 40.

Moreover, near to the chase end and in the intermediate zone the seats 49 for attachment means of the aiming device, front sight and intermediate sight when required (not illustrated) are formed.

The preferably metallic band 60 is the element for joining the barrel with the rib. It consists of a plate with preferably rounded edges, slightly shorter than the rib and having a plurality of longitudinal shaped openings 62, shaped like a keyhole having a wider portion 63 in which the column 22 is to be introduced and a narrower portion 64 suitable for engaging the groove 23 of the column 22 through its own edges.

Such shaped openings 62 are realised at regular intervals, spaced apart like the bases 20.

At the slot 48 realised on the aiming plane 41 of the rib, an actuation hole 65 is formed for the axial sliding of the band in the rib.

The band 60 is entirely inserted in the appropriate channel 45, formed in the rib, until the wider portions 63 of the shaped openings 62 correspond to the corresponding cylindrical seats 47 of the rib.

The rib with the band 60 inserted is positioned on the barrel, making the two top lever seats 51 correspond to the top lever bases 30, 31 arranged at the ends of the barrel.

Each base 20 is made to adhere to the corresponding projection 46 of the fins 43 of the rib.

In such a position, the actuation hole 65 of the band 60 corresponds with the slot 48 realised on the aiming plane 41.

By inserting a pointed tool like a punch, a pin driver or simply a nail through the slot 48 of the rib, the actuation hole 65 of the band 60 is connected and the band is made to translate towards the chase end until the narrower portion 64 of the shaped openings 62 of the band engages with corresponding grooves 23 of the columns 20 and until the band reaches the abutment 50.

Advantageously, the band 60, as well as carrying out the mechanical attachment function, given its elastic characteristics also carries out the task of damping the possible variations, due to the mechanical coupling clearances.

To carry out such a function it is realised suitably undulated in order to recover, with elastic deformation, the processing clearances of the barrel and rib components.

In this way the purposes of the invention are realised since:

- assembly and disassembly take place with ease, without the need for specific tools; a simple pointed object is sufficient;
- small elements, which can get lost during the disassembly steps for the replacement of the ribs, are not necessary for attachment, since the top lever bases 30, 31 stably fix the rib axially and, moreover, the attachment band is an element stably incorporated in the rib;
- the rapid interchangeability allows the choice of rib to be optimised thanks to the provision of a set of ribs with different weight and finish characteristics;
- possibility of disassembling and reassembling the rib without disassembling the barrel from the rifle; it is sufficient to loosen the front attachment cap to obtain a clearance of the barrel that is sufficient to allow the withdrawal of the rib;
- certainty of stable attachment of the rib; the assembly and disassembly operations can be carried out only with the attachment cap partially unscrewed, for which reason it can never become detached during use, when the cap must necessarily be fully locked;
- advantageously, the weight of the barrel with interchangeable rib made from steel does not exceed the weight of an equivalent barrel with conventional fixed rib.

What is claimed is:

1. Interchangeable rib (40) for a rifle that is U-shaped and comprising an aiming plane (41) and two interfacing longitudinal fins (43), defining a channel (45) between them suitable for slidably receiving a band (60) equipped with shaped openings (62) inside of it, each of the shaped openings (62) being suitable for engaging a corresponding column (22) extending from a fixed base (20) to a barrel (10) of the rifle, the rib (40) being equipped with a slot (48) corresponding to an actuation hole (65) formed in the band (60) through which it is possible to actuate the sliding of the band (60) so as to take the edges of the shaped openings (62) to engage in grooves (23) realised along the columns (22) to prevent the detachment of the rib, said rib (40) also comprising, at at least one of its ends, a top lever seat (51) which is coupled with at least one top lever base (30, 31) correspondingly realised on the barrel to prevent the longitudinal sliding of the rib.

2. Interchangeable rib according to claim 1, wherein the fins (43) of said rib (40) comprise a plurality of projections (46) interrupted by ports (52) foreseen at the positions of the bases (20, 30, 31) so as to copy the shape of these to position the rib.

3. Interchangeable rib according to claim 1, wherein the fins (43) of said rib (40) have, on the inside, a converging profile and/or projections (44) directed inwards so as to partially close the upper portion of the channel (45) in order to hold the band (60) inside of it.

4. Interchangeable rib according to claim 1, wherein said rib has a pair of top lever seats (51) arranged near to its ends suitable for each being coupled with one of two top lever bases (30, 31) respectively fixed near to a breech plane (13) and to a chase end (12) with which the barrel (10) is equipped.

5. Interchangeable rib according to claim 4, wherein said rib has the channel (45) open towards the rear part of the rib, corresponding to the breech plane (13) and interrupts near to the front end of the rib corresponding to the chase end (12) through foreseeing an abutment (50) realised in the form of a thickening of the aiming plane (41).

6. Interchangeable rib according to claim 1, wherein said rib has, along the channel (45) formed in the inner surface (42') of the aiming plane (41) a plurality of equidistant cylindrical seats (47) arranged between the projections (46) each to house the end of a column (22).

7. Interchangeable rib according to claim 1, wherein said band (60) has said plurality of longitudinal shaped openings (62) configured as a keyhole comprising a wider portion (63) in which the column (22) is to be introduced, and a narrower portion (64) suitable for engaging the groove (23) of the column (22) through its edges.

8. Interchangeable rib according to claim 1, wherein said band (60) is realised through a metallic plate with rounded edges and is suitably undulated in order to recover the processing clearances of the barrel and rib components with elastic deformation.

9. Rifle comprising an interchangeable rib (40) according to any one of the previous claims.

10. Rifle barrel comprising an interchangeable rib (40) according to any one of claims 1 to 8.

* * * * *

UNITED STATES PATENT AND TRADEMARK OFFICE

CERTIFICATE OF CORRECTION

PATENT NO. : 6,839,999 B2
DATED : January 11, 2005
INVENTOR(S) : Gussalli Beretta It is certified that error appears in the above-identified patent and that said Letters Patent is hereby corrected as shown below:

Title page,
Item [75], Inventors, change " Beretta" to -- Gussalli Beretta --.

Signed and Sealed this

Third Day of May, 2005

JON W. DUDAS
*Director of the United States Patent and Trademark Office*